US010940397B2

(12) United States Patent
Daniel

(10) Patent No.: US 10,940,397 B2
(45) Date of Patent: Mar. 9, 2021

(54) ADVANCED BUMPER CAR AMUSEMENT PARK RIDE AND ANCILLARY SUPPORT FOR SAME

(71) Applicant: Maurice Daniel, Alexandria, VA (US)

(72) Inventor: Maurice Daniel, Alexandria, VA (US)

( * ) Notice: Subject to any disclaimer, the term of this patent is extended or adjusted under 35 U.S.C. 154(b) by 0 days.

(21) Appl. No.: 16/800,823

(22) Filed: Feb. 25, 2020

(65) Prior Publication Data

US 2020/0306653 A1 Oct. 1, 2020

Related U.S. Application Data

(60) Provisional application No. 62/919,022, filed on Feb. 25, 2019.

(51) Int. Cl.

| | |
|---|---|
| ***A63G 25/00*** | (2006.01) |
| ***A63G 33/00*** | (2006.01) |
| *A63G 31/16* | (2006.01) |

(52) U.S. Cl.

CPC ..... *A63G 25/00* (2013.01); *A63G 33/00* (2013.01)

(58) Field of Classification Search

CPC ..... A63G 7/00; A63G 21/00; A63G 21/16; A63G 31/00; A63G 31/16; A63G 25/00; A63G 33/00

USPC ..... 472/43, 59, 60, 61, 85, 88–89, 130, 134; 434/34

See application file for complete search history.

(56) References Cited

U.S. PATENT DOCUMENTS

| | | | | |
|---|---|---|---|---|
| 5,531,644 | A * | 7/1996 | Marumo | A63G 31/16 244/171.9 |
| 7,465,236 | B2 * | 12/2008 | Wagels | A63G 31/00 434/34 |
| 7,896,752 | B2 * | 3/2011 | Yule | A63G 21/18 104/23.2 |
| 2007/0089630 | A1 * | 4/2007 | Gordon | A63G 7/00 104/53 |

(Continued)

*Primary Examiner* — Kien T Nguyen

(74) *Attorney, Agent, or Firm* — Juan Carlos A. Marquez; Marquez IP Law Office, PLLC

(57) ABSTRACT

A novel space theme amusement park ride is disclosed consisting of a fleet of sophisticated bumper-car type vehicles operated by players within a large dome covered facility. The vehicles are configured to resemble combat spacecraft and are equipped to float above the floor on an air cushion supplied by mechanisms within the vehicle. Each space car vehicle seats a number of players who work as a team and play different roles within the space car such as gunner, helmsman, and Captain. The vehicles are equipped with functioning controls that perform and/or simulate various functions, such as steering, spin control, communications, and simulated weapons' systems. The vehicles and auxiliary equipment include automated devices that override player controls when needed to keep player vehicles within safety limits and to direct the vehicles off the floor at the end of their rides. The floor is circular and may be a thousand feet or more in diameter and simultaneously support 100 to 150 space cars, as for example. The playing floor may be surrounded by a multi-level shopping mall and parking garages that adhere to the space theme. The playing floor may also be encircled by viewing areas, bleachers, restaurants, cafes, and the like that make use of the simulated combat taking place on the gaming floor as visual entertainment to spectators.

16 Claims, 3 Drawing Sheets

(56) References Cited

U.S. PATENT DOCUMENTS

| | | | | |
|---|---|---|---|---|
| 2008/0125230 | A1* | 5/2008 | Rowe | A63F 9/02 463/52 |
| 2011/0218047 | A1* | 9/2011 | Kessler | B60K 1/00 472/89 |
| 2015/0190726 | A1* | 7/2015 | Frolov | A63G 31/16 472/61 |

* cited by examiner

ADVANCED BUMPER CAR AMUSEMENT PARK RIDE AND ANCILLARY SUPPORT FOR SAME

This application claims priority to Provisional Application No. 62/919,022 entitled "Advanced Bumper Car Amusement Park Ride and Ancillary Support For Same" filed on Feb. 25, 2019 by the inventor, Maurice Daniel, the entire contents of which are hereby incorporated by reference.

BACKGROUND OF THE INVENTION

Bumper car rides have been a favorite amusement park ride going back as far as the 1920's and still delight amusement park visitors. These vehicles, also known as bumping cars, dodging cars, dashing cars, and Dodgem; are usually one or two passenger electric motor-driven conveyances that ride on a smooth flat metal floor. The passengers, or players, are able to control the speed of the vehicle by means of a foot pedal, and control the direction of movement of the vehicle by means of a steering wheel. The bumper cars are generally crowded together on a relatively small floor (such as 6000 square feet). The vehicles can only travel at low speeds and are designed to allow the players to deliberately move their vehicle to strike, or "bump", other vehicles. The players thereby have fun in disrupting the movement of the other bumper cars on the floor.

Normally, bumper cars are moved by means of small electric motors located in each car. The power is supplied between an electrically conductive floor, set at ground polarity, and a wire mesh ceiling that conducts the "hot" electric polarity. The car has brushes on the bottom to making contact with the metal floor to receive the first polarity, and is equipped with a pole-mounted brush that touches the ceiling to receive the second polarity. The ceiling is set high enough to be out of reach of the players. The ride operator has access to an electric switch that enables him/her to simultaneously supply power to all the bumper cars on the floor at the beginning of the ride period, and to turn off power to all the cars at the end of the ride period.

Several variations to the original bumper car system have been tried in the past. In one variation, bumper cars were made to operate on batteries; but the long battery charging times made the system uneconomical. Another variation that had been tried was to make the floor into a pattern of metal conducting strips of alternate electric polarity, such that an arrangement of brushes on the bottom of the car always making contact with both polarities of electricity regardless of the car's orientation or position on the floor. For safety reasons this system requires the use of inefficient low voltage electric power.

Another system that was used by Disneyland in the mid-1960s employed bumper cars called "Flying Saucers" that floated on an air cushion supplied by the floor, similar to an air hockey game table. The players controlled the direction of the cars by shifting their body weight. The ride employed an awkward sweeper arm to remove cars from the floor after the end of their ride period. The ride proved to have too many mechanical problems and was discontinued after only five years of service.

OBJECTIVES & ADVANTAGES OF THE INVENTION

One object of this invention is to make a bumper car style amusement ride into a spectacular main attraction in a large amusement park. This would draw in large numbers of visitors to the amusement park thereby allowing the park owners to make significant revenues off the ride and its many ancillary business activities. This is accomplished in part by greatly increasing the scale of the facilities to where over a hundred multi-passenger vehicles can be operating simultaneously.

Another objective of this invention is to provide players with a simulated combat gaming media that utilizes bumper cars configured as spacecraft. But whereas bumper car rides of the past encouraged collisions between cars, the "space cars" of this invention allow players to engage in simulated combat by using simulated laser guns that cause simulated damage to opponent space cars. This avoids the safety concerns of repeated collisions between bumper cars.

Another objective is to give the entire simulated combat taking place on the space car floor the visual and sensory excitement of a pinball machine. To this end the laser guns give off lighting effects when they are fired; the laser beams may be semi-visible in the air; and panels mounted on the vehicles light up when hit. Multiple hits to a space car may set off flashes of light, sound effects, and pyrotechnic displays. These effects and displays, combined with the large number of space cars engaged in simulated combat at any one time, provide spectacle and excitement to players as well as visitors watching the simulated combat.

Another objective is to give the space car ride the feeling of riding in an actual spacecraft. So, instead of using wheels and a steering wheel to control the vehicles, the space cars ride just above a metal floor on an air cushion making the motion of the vehicle frictionless, similar to an actual spacecraft in space. Motion in any direction continues until it is changed by firing small air jets along the sides of the vehicle, similar to course corrections performed by actual spacecraft.

Another objective is to give players active control over the movement of their space cars and simulated weapon systems to increase the realism of their ride experience. Unlike most amusement park rides that give riders little or no control over their ride experience, the space cars of this invention provide each player with an array of functional controls. The players can control the speed, direction, and rotation of their car; and they can control firing, shielding, and energy levels of their weapons.

Another objective is to fully immerse the players in the roles they are playing to enhance the experience. This is accomplished by issuing space uniforms to the players and giving them training prior to embarking on the rides. After training the players may choose to play the roles of Captain, Navigator, Helmsman, Communications Officer, Gunner, and the like on board the space cars.

Another objective is to give the players the feeling of actually being above the Earth in space. This is achieved by making the playing arena very large in size and by coloring the floor and ceiling black. A globe of the Earth is placed at the center of the circular floor and painted or otherwise configured to resemble the Earth as seen by astronauts in space. The dome ceiling is patterned in small lights of various intensities and colors to resemble the star-lit sky as seen in space.

These effects taken together present a panorama that leaves the players and visitors in a state of awe. The entire Space Theme Amusement park Ride (STAR) becomes a continuous science fiction drama that draws in players and observers alike.

SUMMARY OF THE INVENTION

The space car amusement park ride of this invention is a greatly scaled-up version of a bumper car amusement park ride, with a circular floor larger than a football field in diameter and covered by a circular dome. The space cars enter the floor from a number of launch points around the edge of the floor and then all travel in orbits around the center. The vehicles all travel in the same direction (clockwise or counter-clockwise) in decaying orbits. When they reach a proscribed distance from the center, computers take control of the vehicles and direct their motion into exit points near the center of the arena. The vehicles then travel along pathways under the floor back to their launch point where the players disembark and are replaced with a new crew.

The space cars of this invention are roughly the size of a large automobile and provide seated positions for 7 to 10 players. The vehicles are designed to meet the functional and safety requirements of an amusement park ride. They are bumper cars and as such are surrounded by shock absorbing bumpers that can greatly reduce the impact forces of collisions with other vehicles. However, the ride is designed to avoid most collisions and to greatly reduce the relative speed of impact for those collisions that are allowed to occur.

Instead of riding on electric motor driven wheels, the space cars of this invention are supported above a smooth floor by four or more air pads. The air pads, mounted beneath the vehicles, emit and trap compressed air beneath them allowing the cars to travel in a nearly frictionless manor around the playing floor. To keep the cars moving in circular orbits around the floor, the floor is slightly funnel-shaped and sloping down towards its center, thus performing like a two-dimensional gravity well. This allows the cars to move around the floor in orbits without requiring fuel or electric power. Newly filled tanks of compressed air are installed in the space cars after each ride session.

Computer automation is used to keep the space cars within certain orbital limits as they circle around the floor while still allowing the players to maneuver their cars within those limits. Computer automation is also used to guide the space cars safely onto and off the playing floor.

The space cars of this invention engage in combat with other space cars on the arena floor by the use of simulated laser guns. The space cars are equipped with a number of detector panels on the outside surfaces of the vehicle that record laser light hits from opponent players. The hits are recorded by a computer and also activate a number of special effects that let the opponent player know that he/she has scored a hit. The players are each provided with a score sheet at the end of the ride that rates his/her combat performance.

In order to increase realism all functions within the space car are resource limited; every working function in the space car consumes digital "energy". For example, the space car as a whole may be provided with a million units of energy. The operation of each function consumes energy; for example, a laser gun may consume 100 units of energy per second each time it is fired. Each function has a detector panel associated with it. If the detector panel is hit by an opponent's laser beam, the energy assigned to that particular function is lost. For example, if a particular gun contains 2000 units of energy, and it's panel is struck by an opponent laser beam, all 2000 units of energy is lost and the gun will no longer function. It is the job of the player in the Captain position to re-assign additional energy from reserves to the gun so that it can function again. Thus, it is the primary job of the Captain is to continually distribute the available energy among the various space car functions throughout the period of combat.

Taken as a whole this invention combines the features of a multi-passenger bumper car amusement park ride with the features of a video game and is played out on a playing floor that may be several football fields in diameter. The detailed features of this invention are described in the drawings and text that follow.

BRIEF DESCRIPTION OF THE DRAWINGS

The present invention is illustrated in the accompanying drawings, wherein.

DETAILED DESCRIPTION OF THE PREFERRED EMBODIMENTS

Description of the Floor and Dome Facilities

The amusement park facilities of this invention consist of a large smooth circular floor, a multitude of semi-autonomous space cars, a number of launch stations along the perimeter of the circular floor, one or more exit mechanisms near the center of the floor, docking mechanisms located under the floor to return the space cars to their launch points, and an operator control facility overlooking the floor to manage the space park activities. The amusement space park ride also includes a number of auxiliary components such as a computerized traffic management system to direct players into and out of the rides, service facilities to clean and re-provision the space cars after each use, and maintenance and custodial facilities.

The entire amusement park space ride and its facilities are housed under a large domed roof structure that is colored black on the inside surfaces seen by the players in their space cars to resemble the black of space. The dome surface would also be covered in a multitude of small lights arranged to resemble stars as seen in space.

The playing field floor would preferably be made of stainless steel that was anodized black to resemble the black of space. Mist, fog, or smoke machines could be installed under the floor and arranged to emit a thin haze near the surface of the floor. This haze would serve to make laser beams visible. The laser light from the simulated space laser guns is thereby made visible as the players beam them between cars. The haze would preferably be some form of water vapor that is harmless to breath in, to avoid long-term health hazards that may be associated with any form of chemical smoke.

Figure 1:
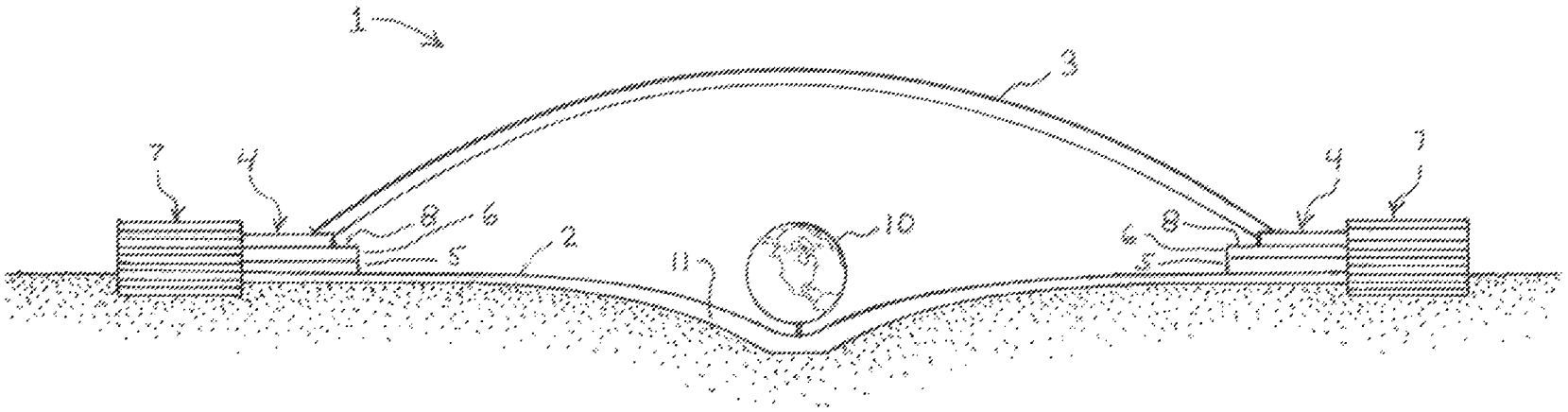
FIG. 1 is a 2-dimensional cross-sectional view of the space theme amusement park facilities.

FIG. 1 shows a cross-section of the space theme amusement park ride facilities and related structures 1. The facilities shown in FIG. 1 are circular, mostly symmetrical, and arranged as an arena. The space cars ride around on the large circular indoor playing floor 2 that is covered by a dome 3. The playing floor 2 is surrounded by a ring of building structures 4, and a second ring of parking garages 7.

The space cars ride on the playing floor 2, which is preferably made of a smooth metal, such as stainless steel anodized with a black surface finish. In the embodiment shown, the playing floor 2 is shown to have a diameter of 1000 feet and is covered by a dome 3 that is approximately 225 feet high above the ground and sufficient in diameter to cover the playing floor 2. These dimensions are for example only and would in practice be determined by design, operational, structural and financial considerations, as would be understood by those skilled in the art.

The building structures 4 surrounding the playing floor 2 are shown to be three floors high above the playing floor. The first floor 5, or ground floor, of the building structures 4 occupies the same level as the edge of the playing floor 2 as shown. The first floor 5 mostly serves to service the space cars and the players. This floor includes space car launching and disembarking facilities, space car command and control facilities, classroom facilities, video game training facilities, and space car maintenance facilities. The second floor 6, and third floors of the building structure encircling the playing floor are mostly occupied by a large number of retail stores and thus forms a large indoor shopping mall. The multi-floor circumference-parking garage 7 surrounds the outer circumference of the building structures 4. Suitable entrances and exits, hallways, restrooms, utility facilities, and the like are arranged between and within the various building structures (not shown).

Because of the large size of this space car amusement park, the facilities are equipped with an electric train that allows players and visitors to travel in comfort to distant parts of the facilities. In the embodiment shown, the rail tracks 8 are shown located on top of the second floor and in front of the third floor. This location for the indoor train allows visitors to quickly travel around the facility while being able to view the playing field from the windows of the rail cars. (The rail tracks and rail cars are too small to show in the scale of this drawing.)

As shown in FIG. 1, the playing floor 2 slopes and curves downward towards the center of the floor so that the floor has the shape of gravity well. The exact slope and curvature of the playing floor is determined in accordance with design, safety, structural, as well financial considerations, to allow the space cars to achieve reasonably safe speeds as they orbit the playing floor, while giving the players the sensation of moving and maneuvering during gameplay. The space cars are designed to circle the floor in decaying orbits so that after several orbits (i.e., 3-4 orbits) around the floor the space cars are making progressively smaller orbits around the center of the floor. When the space cars approach the vicinity of the globe 10, a computer-control system takes over control of each individual space car and directs the car through openings in the floor (not shown) into a sub-floor space 11 beneath the playing floor 2. Within the sub-floor space 11 the computer-control system controls the speed of the space cars and directs their travel through a matrix of pathways. The pathways allow the space cars to travel to any of the launch-pad bays along the rim 5 of the playing floor 2. The computer-control system then directs each car through the matrix back to the same launch bay it started from.

The space car facility includes a globe 10 of the Earth positioned and supported above the center of the playing floor 2 and painted, or otherwise decorated to resemble the Earth. The center of the globe 10 is positioned at the same horizontal level as the outside edge of the playing floor. This gives the space car players the illusion of traveling in orbit around the Earth as they encircle the playing floor. At the scale of this drawing the globe 10 is approximately 120 feet in diameter. The mountains, water, and land features are made in relief and painted with colors that closely resemble the earth as seen from orbit. Additionally, the globe has transparent and translucent layers to resemble the atmosphere and clouds that surround the Earth. The Earth globe is illuminated on one side by an artificial sun (not shown) that illuminates one side of the globe, as well as the entire interior of the dome.

Computer Control and Automation

Each space car includes its own Vehicular Control Computer (VCC) and related software that maintains actual control over all the various functions within the vehicle. The controls that surround each player feed their control settings to the VCC, which then in turn carries out the desired function. This allows the software to evaluate the player's commands for safety considerations before executing them or modifying them. Various sensors on board the space cars track the GPS position of the vehicle on the floor, the speed and direction of travel, the amount of compressed air in the tanks, etc., which then send their data to the VCC. The VCC then analyzes the player's commands and carries them out only if they are within current safety considerations; otherwise they are ignored or modified as necessary.

The operator control facility for the entire amusement space park ride is equipped with a Central Control Computer (CCC) which tracks and controls all the activities taking place on the floor and related activities. The CCC maintains continuous radio/internet communication with all the VCC's in all the space cars that are in service on the floor, from the time they are activated and launched onto the floor until the time they are docked and inactivated. The CCC then combines the VCC information from all the space cars and displays it on a large screen to enable the ride operator to visually assess the ride's current situation. The CCC keeps tally of the time each space car has been on the floor, the number of simulated laser gun firings on each vehicle, The number of simulated laser hits experienced by each space car and which gun was responsible for the hits, the amount of compressed gas onboard each space car, the state of charge of each space car's battery, and any mechanical failures that may take place, as well as a host of other performance and status data.

The CCC also sends control commands to the individual space cars based on current and planned conditions on the playing floor. In this capacity the CCC tracks the paths of each space car to ensure they are following their proscribed spiral "orbits" towards their exit points within their proscribed time allotments. When a space car is maneuvered or drifts out of its proscribed course limits the CCC sends signals to the car's VCC to correct its course by firing bursts of air from its air jets. When the space car approaches its exit point the CCC and VCC computers take full control over the space car to bring it safely to the exit point where it engages a docking mechanism that brings it to rest near its launch point to allow the players to disembark. The CCC and VCC system may also take full control of a space car if a mechanical failure is detected. In this case the CCC also notifies the ride operator of the problem and may receive further instructions from the ride operator. For the most part the CCC operates under software control with a human operator acting in a monitoring role.

Figure 2:
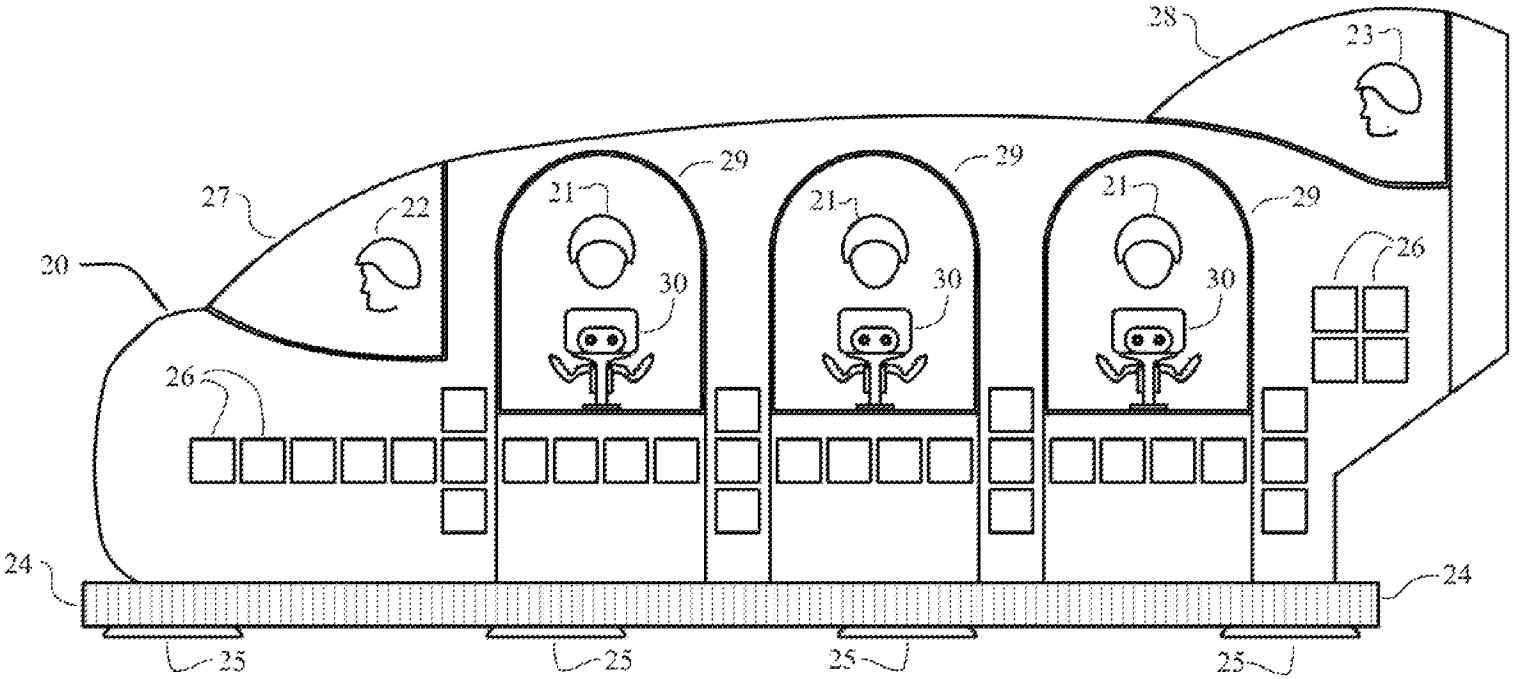
FIG. 2 is the side view of a space car.

FIG. 2 shows one example design of a space car 20 of this invention. In the embodiment shown, the space car 20 measures approximately 16½ feet long and 7 feet high and is configuration to accommodate eight players. The head and helmet positions of the visible players are shown in the drawing including six gunners 21 (three gunners are not seen is this side view drawing), one helmsman/navigator 22, and one captain 23. The space car includes a bottom support platform that is surrounded by a rubber shock-absorbing bumper 24 designed to reduce the impact of a collision with another space car. The space car 20 floats a short distance above the floor on air pads 25 that use air generated by an air cushion system, such as those used in hovercraft as known in the art but on a smaller scale to accommodate a vehicle the size of the space car 20. One example implementation of an air cushion system that could fit in the space car 20 would be to use compressed air supplied by high pressure air tanks mounted within the space car 20.

A number of laser detector panels 26 are mounted on the sides of the space car 20. In the embodiment shown, the detector panels 26 each measure 4-6 inches square. In the embodiment shown, on the left side of the space car 20 there are 36 of these detector panels 26 showing. The size, shape, positioning, and number of these detector panels 26 may vary in alternate designs of a space car 20 of this invention. The detector panels 26 serve to detect "hits" from the laser guns of other space cars at play and to change color and intensity of light when they detect a hit. The detector panels 26 are connected to the Vehicular Control Computer (VCC) in the space car 20 that tallies the number and location of the hits so as to then control the space car 20 in response to the hits and/or communicate information related to the hits and the status of the space car 20 to the Central Control Computer (CCC).

Operation of Light Detector Panels

In at least one embodiment, each detector panel 26 is related to a function or component within the space car 20. For example, one detector panel 26 may be associated with the forward starboard air jet. If the detector panel 26 detects a hit by a laser beam from another space car, all the energy assigned to that function is lost and the function remains inoperable until additional energy is assigned to it. This gives the gunner and his crew the satisfaction of actually having damaged a rival crew's space car.

To further enhance the space car's feel of realism, each detector panel 26 is illuminated by LEDs internal to the panel. The detector panel thereby identifies itself to rival gunners of its existence as a target. When the detector panel 26 is struck by laser light the detector panel changes color. For example, the panel may normally be illuminated by white LED light, but after being struck by a rival's laser beam the detector panel may change color to red. The detector panel 26 would then remain illuminated by red light until additional energy has been supplied to that particular function of the space car 20. This informs the rival gunner that he/she has scored a hit against the space car and has limited its functionality.

It could become too easy for one gunner to completely disable a rival space car by a single sweep of his laser gun over the entire row of laser sensors. Several features could be added to prevent this occurrence. The laser gun 30 could fire an intermittent stream of short burst of laser light, like a machine gun, so that a single sweep would only hit a few panels. Another method would be have the laser beam fire continuously, but design the detector panel 26 to only record a hit if it detects laser light for a full half second or more. This would require the gunner to make a very slow sweep of the rival space car, which would be difficult to do during the dynamic action of space car movement.

Operation of the Pseudo Shields

To further reduce the damage that a single gunner can do to a rival space car, in a further embodiment, various functions or components of the space car 26 are protected by a "shield", which is simulated as another digital feature of the detector panels 26, wherein a certain allocated amount of energy is expended whenever specific detector panels 26 are hit by a laser beam. The laser beam hits are ignored or not tallied until after a threshold amount of laser beam energy is expended against the specific detector panels 26. Once that threshold is reached, that signifies that the "shield" has been expended or breached, and hits by laser light against the detector panel(s) 26 can now be tallied. As will be discussed further hereinbelow, the captain 23 of the space car 20 has the duty of assigning the space car's energy to various functions under his command. He/she would divide up the total energy reserves among the gunner functions, the navigation function, the communication function, etc. and the shields that protect those functions from laser fire from rival ships. As explained above, when a function is shielded it is protected from laser beams until the shield gives out. For example, if 200 energy units are assigned to shield the forward starboard air jet from laser fire, the air jet function would be protected for two seconds of laser fire until the shield consumes its supply of energy and exposes the underlying function to laser fire.

All the detector panels 26 on the outside of the space car 20 have a shield function. The detector panels normally light up with white LED light. This signals that that function is fully operational and is shielded. If the shield does not have an energy reserve, the detector panel 26 is lit up, for example, in blue light. When both the shield and underlying function are depleted of energy units, the detector panel 26 lights up in red light indicating that the underlying function has lost all its energy and is no longer functional.

When a detector panel 26 is first hit by a laser beam, regardless of the status of the shield or underlying function, the panel gives off a flash of bright white strobe light. This provides feedback to the gunner who hit the sensor that his/her aim was successful. It also adds to the action and excitement of the game.

Operation of the Space Car

Unlike most amusement park rides, each seat within the space car 20 of this invention has a specific role-playing function associated with it. These role-playing functions are similar to those of a naval war ship: i.e. Captain, Navigator, Helmsman, Communications Officer, Pilot, Engineer, Gunner, and the like. Each rider in the space car plays the role determined by the particular seat he or she is occupying. Each seat is designed to support its role-playing function with a set of controls that actually perform, or simulate, the related function. For example, the Gunner position has a set of controls to operate a simulated laser gun that can be directed at other space cars. The Pilot or Helmsman position has actual control over a set of air jets that can move or rotate the space car (within certain limits as determined by safety, design, structural and gameplay requirements). Likewise, each of the seats in the space car has a set of controls to support its associated role.

As illustrated in FIG. 2, among the players in the space car 26, a helmsman/navigator 22 is seated in a forward facing cockpit at the front of the space car 26 and is covered by a transparent plastic canopy 27. The captain 23 is seated in a forward facing cockpit at the rear of the space car 26 in an elevated position and covered by a transparent plastic canopy 28. The captain's elevated position at the rear of the car gives the captain 23 a better view of the surrounding simulated combat area as well as the interior of the space car 26. The gunners 21 are seated in gun turrets covered by transparent plastic canopies 29 and operate simulated laser guns 30. In this embodiment, there are three gunners on each side of the space car 26 for a total of six gunners. In alternate designs of the space car, one or more gunners may face forward or rearward for better gun coverage. Alternatively, the helmsman/navigator 22 may be provided with a forward facing simulated laser gun. The number of player positions in the space car may be decreased or increased. For example, gunner positions may be added, and/or a player designated for a Communications Officer position may be added to the vehicle, or the like.

Figure 3B:
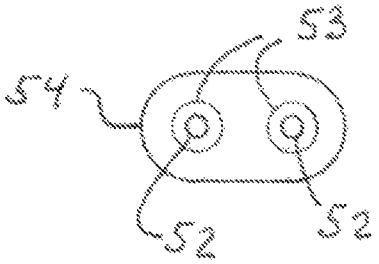
FIG. 3B is a detailed view of the front face of the simulated laser gun.
Figure 3A:
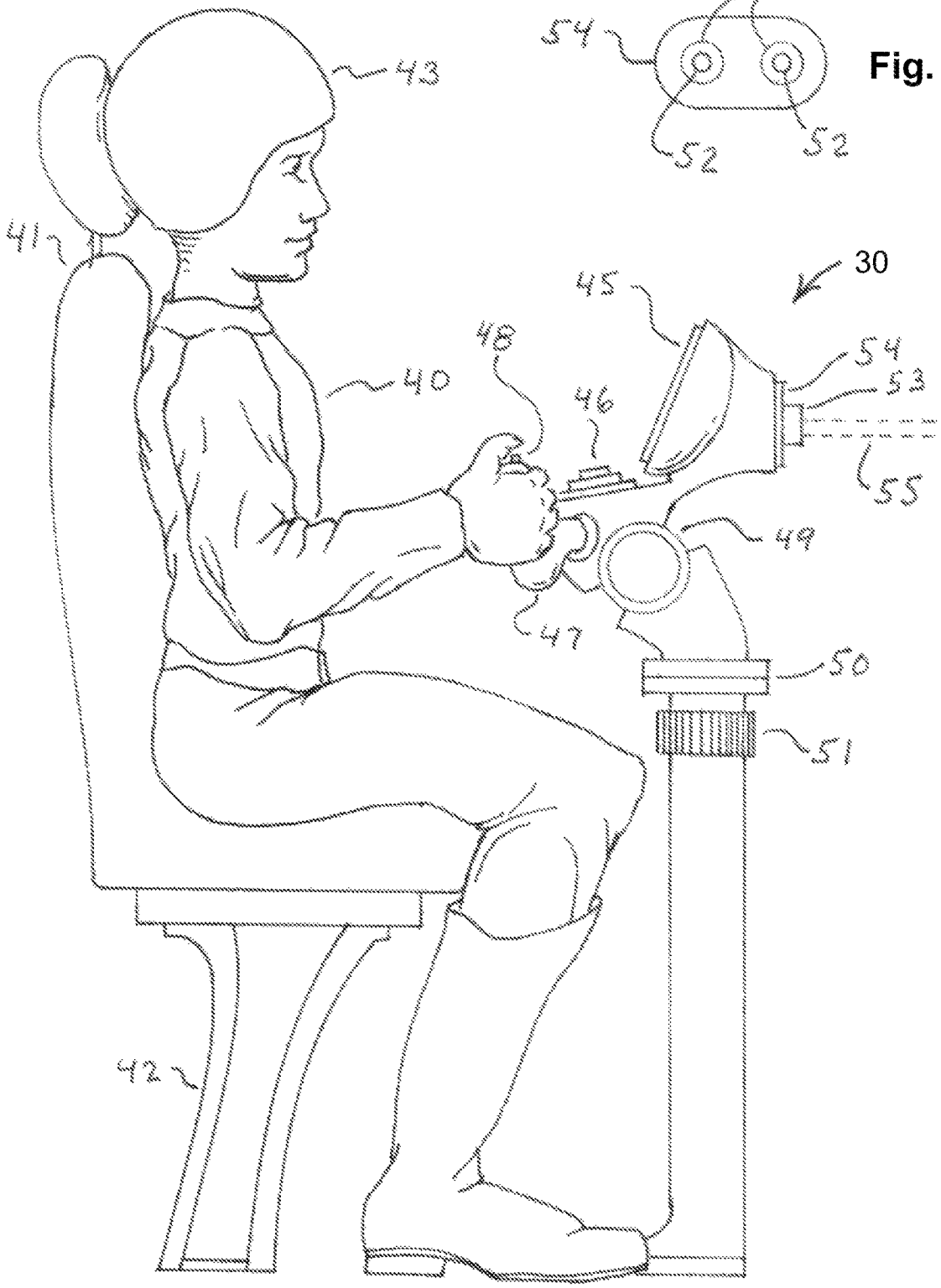
FIG. 3A is the interior of a gunner's turret with a seated player.

FIG. 3A shows a player 40 seated in a gunner's gun turret (shown as 29 in FIG. 2) within the space car 20 and playing the role of gunner. The gunner's seat resides within the gun turret and would be normally equipped with a seat belt (not shown). The seat support structure 42 is securely attached to the floor of the space car vehicle. The gunner 40 is shown wearing a safety helmet 43. The gunner 40 is shown operating a simulated floor-mounted laser gun 30 (see FIG. 2). The upper part of the laser gun has a small screen 45 that provides the gunner with gun status information, such as the amount of energy (ammunition) available to each of the two lasers, the amount of shield protection covering each gun from an opponent's hit, if the gun is armed or in standby mode, and other useful information. The laser gun 30 has a control panel 46 that lets the player set the rate of laser fire, the amount of energy available between the lasers and shields, arming and standby switches, and other control settings. The player fires the simulated laser gun 30 by grasping the two-handled joystick 47 with both hands as shown. (Only a portion of the right handle of the joystick is visible in this side-view drawing.) The gun's firing button 48 is shown beneath the right thumb of the player. The gun turret has a pivot 49 that allows the player to aim the gun in a limited up-down movement, and it also has a horizontal pivot 50 that provides the gun with limited side-to-side movement. The gun mount has an adjustment ring 51 that provides the gun with limited height adjustment to accommodate different size players. The gun and seat may also have other adjustments (not shown) to accommodate different size players.

FIG. 3B shows the front face of the laser gun 30 with its two laser beam ports 52 and surrounding collars 53. The surrounding faceplate 54 is made of glass or plastic and illuminates whenever the gun is fired. The path of the laser beam 55 is shown as it exits the laser gun 30.

Role-Playing Function and ID Cards

In keeping with this role-playing feature, players must be "qualified" to board one of the space cars. To become qualified the players must operate one of the flight simulators that are set up in rooms near the entrance to the space ride boarding points. Flight simulators are set up for each of the space car roles and each player must complete at least one session on the appropriate simulator before they are allowed to board a space car. Players are issued a photo ID license when they successfully complete a flight simulation secession(s). The license for gunner would be the easiest to obtain, whereas the license for captain would require more extensive training sessions including a live training session.

Prior to boarding the space cars of this amusement park ride, the players don simulated space suits to enhance the experience of playing the role. In addition to paying to board a space car, the players must show their photo ID cards that show that they are qualified to operate the controls associated with their role.

All the players that are ready for boarding a squad of space cars gather in a briefing room where they are briefed by the commander of the mission about the conditions and targets for their upcoming mission. Here they also receive basic safety instructions and how to react if their space car is incapacitated.

After the space car session is over the players again gather for a short briefing where they are debriefed about the success of their mission. Each player is given a score card describing their performance during the session and their photo ID is updated to show their added experience in playing their role.

Energy and the Operation of the Pseudo Laser Weapons

In prior art amusement rides, and in video entertainment, the player is usually given virtually unlimited pseudo "ammunition" with which to shoot at his targets until his allotted playtime is ended. In order to make a more realistic enactment of an actual combat spacecraft, the pseudo laser guns, and all other space car functions are limited by "energy".

"Energy" as it is used in the context of this invention, is a digital measure of the functional usage. At the time a space car is launched its computer systems are uploaded with a large quantity of digital "energy", for example one million units of energy. Each time a pseudo gun is fired, or a maneuvering air jet is fired, a quantity of "energy" is consumed as determined by the space car's computers. For example, a main engine burn may consume up to 500 units of energy per second, and a laser gun may consume 100 units of energy per second. Since all the functions in the space car consume energy when they are used, the players must be restrained in the use of their respective functions. This feature adds to the realism of the space car amusement park ride.

Laser guns are the primary pseudo weapons of the space car ride. A space car may be equipped with four or more laser gunners having their guns pointed out the sides, front, and back of the space car. Each time the gun is fired an actual low powered laser beam is fired from the gun toward whatever target the gunner was aiming at. These laser beams would be made visible in the air between ships by creating a water vapor haze in the air near the playing floor.

Captain's Control Over Energy Allocation

One of the primary roles of the space car's captain is to effectively assign the space car's available energy to all the ship functions throughout the ride and associated simulated combat. To perform this task the captain would have a large interactive screen that pictures every ship function in symbolic form along with its current allocation of energy and operational status. The screen gives the captain the ability to transfer energy from one function to another by a simple finger movement as the space combat progresses.

When the space car suffers a laser hit to one of the sensor panels, energy is lost to the corresponding function. The captain can replace the lost energy from energy held in reserve. The captain can also put energy into his shields, move energy from one side of the ship to the other, remove energy from any function and send it back into reserve or into another function. The energy transfers may have small delays built into them as required to maintain the best flow of the simulated combat.

As an example, if during simulated combat, attacks are coming from the starboard side of the space car, the captain may transfer energy from the port side shields into the starboard side of the vehicle to better defend that side of the space car.

The space car would be allocated a finite amount of energy units at the start of the mission; for example, one million units of energy. The captain must carefully allocate these energy units so that the space car still has energy available by the end of the mission. The firing of a single laser gun, the firing of a thruster, or the activation of a shield may each expend 100 units of energy per second.

For example, the captain may provide gunner #1 with 10,000 units of energy at the beginning of combat. If during combat gunner #1 receives a well-placed series of four hits he/she could lose all remaining energy for his/her laser guns and shields. The captain would then have to send additional energy units to gunner #1 to bring back defenses on that side of the space car. So, during the course of a mission as much as half of the space car's energy may be lost to laser strikes against the space car. Considerable strategy would be required to survive to the end of the mission with some energy in all systems.

Navigation Function

The navigator would have a navigation screen that displays a map view of all the "friendly" and "rival" space cars in his/her vicinity. The navigator would then be able to plot a course for the Helmsman follow for better combat advantage. The navigation screen may also display the positions the anticipated "orbital paths" of all the vehicles on the playing floor, the position of the Earth, and the positions of "space stations" in orbit.

Summary of Space Ride Play Operation

The overall objective of the space car amusement park ride of this invention is to give the riders/players the simulated experience of flying in a spacecraft that feels as real as possible within the constraints of an amusement park ride. To this end the space cars float on air cushions to give the players complete freedom of movement in two dimensions. The players can move and steer their vehicles by means of air jet thrusters, similar to the way actual spacecraft move in space. The space cars move around a large circular track in simulated orbits. A large illuminated globe of the Earth may be placed at the center of the floor to enhance the illusion of orbiting the earth. The floor and ceiling would be colored black to resemble conditions in space and small lights would be arranged on the ceiling to resemble the appearance of stars as seen in space.

The space cars are armed with a number of simulated laser guns that are operated by the players to fire at other space cars on the playing floor. The space cars may be equipped with four or more laser guns pointing out the sides, front, and back of the space car. Each time a gun is fired an actual, harmless, low powered laser beam is fired from the gun toward whatever target the gunner was aiming. The laser-light detector panels record hits of laser light from any of the other space cars on the floor. Both the firing of the simulated laser guns, and the detection of laser beam "hits" on the laser detection panels, are recorded by the vehicle and central computer control systems.

The players begin their session by dressing in simulated space suits, attending a "mission" briefing, and then boarding their space cars and undergoing "checkout". This process may require an hour or more. The space cars are launched onto the floor in groups (squads), undertake four or five orbits of the track while engaging in simulated combat activities, and are removed from the track by an automatic mechanism. This time on the floor would be about 20 to 40 minutes. After "docking of their space car the players disembark, attend a short debriefing, and receive written and digital performance reports. This final disembarking period may take from fifteen to thirty minutes. This entire space ride experience may take two hours and cost a nominal fee of only $35 per player. The space ride thus serves as a draw to bring in patrons into the amusement park where they can spend money on many ancillary products and services.

Player Ride, Embarking and Disembarking Cycle

After the players embark into their space cars, are secure in their seats, and complete checkout; a launch mechanism is used to set the space cars onto the circular playing floor. The launch mechanism may employ a hydraulic mechanism, a spring mechanism, or the like to start the space car moving into a tangential orbit at a preset speed and direction. If the players do nothing to change the movement of the space car ride, its path will follow a spiral path, or orbit, decaying towards the center of the floor. After a predetermined number of cycles around the floor, for example 5 orbits, it will be in close proximity to an exit mechanism near the center of the floor. The CCC and VCC computers will then take full control over the vehicle and guide it into an exit track. The track will guide the vehicle back to the vehicle's hanger. Once the vehicle is locked into its bay, the passengers will be free to disembark.

The space car's hanger is located in the near vicinity of its launch bay. After the players disembark at the space car hanger, a maintenance crew performs a safety check of the vehicle, performs any necessary custodial tasks on the vehicle, and replenishes the tanks of compressed air and other consumables. An electronics check is also performed on the vehicles. The vehicles are then moved into their launch bay where a new player crew embarks.

Player Controls

Each player in a space car vehicle has a control panel in front of him/her with controls that actually perform effects when operated by the player. Those players playing the role of gunner are equipped with the most basic control panel. The gunner is equipped with a turret-mounted simulated laser gun that can be swiveled from side to side and up and down, and is equipped with a push-button trigger mechanism. The gunner's control panel has a counter that provides the gunner with the number of energy units available to operate the laser, and displays diminishing numbers as the simulated laser gun is fired. The gunner's control panel also has a counter to record the number of energy units available in his/her shield. The gunner's control panel may also control the duration of laser burst, the duration of a shield response to a laser hit, and other gun operation customizing controls.

All space car control panels would include a video communications screen and speaker/microphone to communicate with the ship's captain, crewmembers, and to receive communications from central command. Family and friends, who are not at play, may be able to communicate with a player through the ships screen for a small fee. The ship's computer may also communicate to an individual player to give advice on how to operate the controls more effectively, or to give warnings of various types. The screens may also periodically provide coordinates and targeting information on the opposing space cars.

The control panels include an autopilot function, which takes control over from the player during launch, during vehicle recovery and docking, and periodically to adjust the vehicle's orbit for safety reasons. The player has limited control over this function and may engage the autopilot feature to pause and rest during the play period.

Laser Gun Action

The simulated laser guns actually do fire a low energy, eye-safe, laser beam as directed by the gunner. There are two side-by-side laser guns attached to the same gun mount as shown in FIG. 3A. The gun mount provides the player with limited side-to-side and up-and-down movement enabling the gunner to follow the movement of near-by targets. The gunner fires his/her lasers using a two-handle joystick and buttons as shown in FIG. 3. The guns fire a rapid series of laser bursts for as long as the gunner pushes the firing button on his/her guns, or until the gun's energy units are used up. Each time the laser guns are fired the front face-plate of the laser gun lights up so that the opposing players can see that they are being shot at. (For the most part the laser beams cannot be seen in clean air.)

If economics allow for it the game floor would emit impurities in the air up to the height of the space cars to allow the laser beams to be seen in the air. One method of doing this would be to pump some form of artificial smoke into the air from small holes in the floor. The smoke would have to be harmless to the players and inexpensive to use and maintain. Another method would be to keep the air above the floor near the dew point to allow a slight water vapor fog to form just above the floor. The water vapor fog would make the laser beams somewhat visible in the air.

Consequences

In order to enhance the realism of the space car amusement park ride the successful hit of an opponent's laser beam on a detection panel is made to have a number of consequences to the victim of the hit. As describe previously, each panel is directly associated with a function of the space car. One panel, for example, may be associated with the left laser of gunner #3. In order for left gun #3 to operate it must have sufficient units of energy assigned to it by the gunner or the ship's captain; for example, 1,500 energy units. If that particular detector panel is hit by an opponent's laser beam, all 1,500 energy units are lost and the laser gun will no longer operate.

Each laser gun may be protected by a "shield" which also depends on energy to function. For example, a shield may have 200 energy units assigned to it by the gunner. If the gun detector panel is hit one time 100 units of shield energy is lost but the gun still retains all its energy. If the detector panel is hit a second time the last 100 units of shield energy is lost but the laser gun still retains its energy units. If the detector panel is hit a third time there is no shield protection left, and the full 1,500 units of gun energy is lost and the gun will no longer function. So, an important part of the game is to keep managing where the energy is distributed among the many ship's functions to shuffle between offence and defense capability and conserve as much energy as possible.

The detector panels normally light up in white light. If the shield is in operation, and the panel is struck by an opponent's laser beam, the panel gives off a flash of strobe light, for example in the color blue. This informs the opponent player that he/she hit the shield. After the shield is hit, the panel continues to be lit in white light. If the gun is unshielded and is hit by an opponent's laser beam the panel gives off a bright white strobe light and thereafter remains illuminated in red light. This informs the opponent player that he/she has successfully knocked out the left gun #3 (for example). The space car captain may then send additional energy units to gunner #3 who may then restore his gun to functioning status, at which time the associated detector panel will revert back to illuminating in white light.

The space cars may also be designed to give off a warning sound when a shield is struck and give off a much more severe sound if the underlying function is drained of energy units. The severity of the sounds would be in proportion to the amount of energy lost by the hit. To further increase the consequences of a significant hit, small air jets may fire a pulse of air near the location of the hit. This would allow the players in the space car to feel the hit as well as see and hear it. The strength of the air pulse would be in proportion to the amount of energy lost by the hit. The air jet pulse would change the movement of the air car and would likely cause the space car to begin to slowly spin. These movements would have to be corrected by the Helmsman. If a large number of hits are scored on a space car it would be designed to give off artificial smoke and the red illuminated panels would become brighter and pulse in red-orange-yellow light to simulate fire. These effects would make a car with multiple hits against it become quite a spectacle to all the other players and observers in the space car amusement park.

Space Car Air Cushion System

The space cars of this invention most closely resemble a hovercraft, whereby the vehicle rides on a cushion of air supplied from within the vehicle. This is to be distinguished from air table flotation arrangements, such as employed in an air hockey table, where the table supplies the air through holes in its surface and the air puck merely has a flat bottom that traps the air beneath it. The air needed to levitate the space cars is supplied from within the vehicles by either, as examples, tanks of compressed air or by small air compressors. The compressed air is directed into air pads located beneath the vehicle that keep the space car suspended above the floor continuously throughout the period of the ride.

Hovercraft typically ride a foot or more above the ground and are thereby able to float over rough surfaces or open water. The space cars of this invention are designed to ride over a smooth metal surface and therefore only need to levitate less than an inch off the floor. Typically, the space cars would be designed to float only ¼ to ½ inch above the playing floor. The space cars are equipped with a set of air flotation pads having a special shape designed to trap air beneath them. The air flotation pads keep the cars floating above the floor in a nearly frictionless condition. Once a space car is given a push in one direction, it continues moving in that direction until it is stopped or diverted by the car's air jet thrusters. This type of frictionless motion resembles the motion of a real spacecraft and thus contributes to the rider's feeling of traveling in a spacecraft.

Space Car Maneuvering Propulsion System

The space cars are equipped with at least two sets of air jets that are used to change the speed and direction of the space car. The air jets, or "thrusters", are small nozzles that emit jets of compressed air from preset positions around the vehicle. The compressed air is supplied by two or more tanks of compressed air that reside onboard the space vehicle. One set of thrusters are located fore and another set are located aft on the space cars and are used to speed up or slow down the vehicles. Other sets of thrusters are located on the sides of the vehicle and are used to steer or rotate the vehicle. The space car player occupying the role of helmsman operates the thrusters throughout the space ride.

However, the CCC and VCC overrides the players commands during launch onto the floor and exit from the floor. These automated systems take over control of the thrusters wherever the space car drifts outside of its proscribed flight envelope, and returns control back to the helmsman when the vehicle re-enters its flight envelope. The automated system also takes over temporary control of the thrusters whenever a collision between two vehicles is emanate. In this case the collision may be allowed to take place, but at a very reduced relative speed.

The thrusters also have the ability to set the space car into a controlled or uncontrolled spin, depending on the situation. The helmsman has the ability to set the vehicle into a spin in order to better position the craft to fire on an opposition space car. But after turning the space car, the thrusters must be fired in retrograde mode to stop the spin. If this maneuver is not undertaken the vehicle will continue its uncontrolled spin. Uncontrolled spins could occur during combat if the thruster function is hit by opposition laser fire. Under these circumstances an automated system will keep the spin within reasonable spin rates. The helmsman would be given an emergency de-spin control option, but at a heavy cost of energy usage.

The depleted air tanks for the thrusters are removed and replaced with full air tanks at the end of each ride. Since the thrusters are critical to the safety of the space ride, generally each vehicle is equipped with a redundant backup air-tank and thruster system. The thrusters are equipped with LED lights to illuminate their exhaust, for example, in pale blue light when they are fired, to further enhance the spacecraft illusion.

Playing Floor Size

The space car amusement park ride is designed to accommodate a hundred or more space car vehicles on the floor simultaneously. Since each space car vehicle is designed to hold 7 or 8 passengers, the vehicles would measure approximately the size of a full size automobile, or about 15 to 20 feet in length. One hundred cars end-to-end would be 1,500 feet. This would form a circle approximately 477 feet in diameter. This would probably prove to be too close together; a circumference spacing of two car lengths per vehicle would probably be more realistic. Two-car spacing of 100 cars would form a circle 3,000 feet in circumference, or 955 feet in diameter. A floor space circumference of one mile, having a diameter of 1,681 feet, would be able to accommodate 176 space cars on the floor at one time. Economic and safety analysis would have to be undertaken to determine the optimum floor size and maximum number of space cars. For the remainder of this description it will be assumed that the playing floor measures 1,000 feet in diameter and accommodates 100 space cars on the floor at one time.

Entertainment Value and Exploitation Thereof

This amusement park ride serves to entertain the players who ride the space cars and participate in simulated high-tech combat with one another. However, before the visitors become players they must go through training, which is undertaken in classrooms and by video game simulators, which surround the playing floor. Many of the video game players may never actually choose to ride in one of the space cars because of being too old, too young, or for other reasons. But these video game players come to the amusement park because of the entertaining spectacle of the simulated combat taking place on the amusement park floor. An even larger number of visitors may spend hours at the amusement park watching the simulated combat while shopping, eating at restaurants, or just watching the activities from viewing areas surrounding the floor. With this in mind the building housing the playing floor is designed to provide maximum opportunities and vantage points to view the simulated combat.

At the level of the playing floor, surrounding the floor, are the various facilities for attending to the needs of the players. This includes four or more simulated "space stations" where the players congregate to embark and disembark the space car rides. But it also includes briefing rooms where players meet briefly before their rides to be instructed on the current combat situation on the floor. In these rooms the players don space suits before entering their space cars and are given instructions on behavior expected of them on the floor. There are also video game rooms where players can learn the space car controls and train to play the roles of gunner, navigator, helmsman, captain, etc.

The floor above the player's floor is the main deck of the facility. It features a wide promenade with a handrail that completely encircles the playing floor, thus allowing pedestrians to walk around the playing floor and view the action from any viewpoint. Just behind the promenade are various stores, restaurants, and other facilities similar to a commercial mall, but all having a space theme. As an example, the playing floor plus promenade may have a diameter of 955 feet giving the vendor's facilities 3,314 feet of frontage. If the average storefront is 33 feet, this provides real estate for approximately 100 vender establishments that overlook the playing floor. Any number of other vendor stores may be established behind this first ring of stores. The rental income from these stores would provide a major source of income for the amusement park facilities.

A third floor may be established above the main deck. In place of a promenade, this third circular floor would contain tracks for an electric train to ride on. Passengers on the train would get a view of the playing floor from one side of the train as it circles the playing field. The train would stop at each of the launch points around the perimeter of the playing floor to pick up and discharge passengers. The floor space behind the train tracks may have additional stores and vender space.

Earth Globe & Gravity Funnel

As much as possible, the arena under the large dome is designed to resemble the experience of being in space. The floor is preferentially made of black anodized stainless steel resembling the black of space. The dome ceiling is also made of materials that are coated or painted black. The dome ceiling has thousands of small lights installed and arranged in patterns that resemble the stars and Milky Way as seen in the night sky. In contrast, the space cars are made of bright white and/or colored shells that make them visually stand out against the black background of the domed arena.

To further the illusion of being in space the playing floor curves downward towards the center of the arena in the shape of a curved funnel. A large globe of the Earth is suspended or otherwise mounted above the center of the floor and positioned so that the Earth's equator is at the same height as the edge of the arena floor. The floor shape is made to mimic a "gravity well" as often illustrated in physics books. This geometry causes the space cars, once set in tangential motion around the floor, to naturally follow circular orbits around the globe without the need to supply them with an engine or motor to maintain their motion. Friction will cause the orbits to eventually decay into ever-tighter circles until the cars reach the center of the floor.

Each space car is riding above the floor on essentially a frictionless cushion of air. If left alone the cars would orbit for days before reaching the center of the large arena. The VCC computer therefore periodically fires bursts of compressed air in the car's forward direction to slow the car down so that it only orbits for some allotted number of orbits; as for example from four to six orbits. The VCC computer calculates the timing and amount of compressed air bursts needed to position the cars to be at the correct exit position after traveling the allotted number of orbits. Mechanical mechanisms then direct the still moving space cars into pathways 11 beneath the playing floor 2. A labyrinth of passageways beneath the playing floor 2 then guides the cars back to their starting stations.

While on the floor, all space cars must orbit around the floor in the same direction in order to avoid violent head-on collisions between cars. For example, the space cars may all be moving counter-clockwise around the center of the floor at considerable speed; for example, from 20 to 30 miles per hour (mph). However, relative to each other they may average only 2 to 4 mph. The players do have limited control over the speed and direction their cars are moving, within the parameters of their computer assigned orbital envelope.

This allows the players to maneuver their space cars into position to engage in simulated combat with one another. However, the space cars are bumper cars, and a player may cause his/her car to intentionally collide with another car within the orbital envelope. In such a case the VCC computers would restrict the impact to some relative safe speed; such as one to two mph.

With this understanding of how the space cars travel around the arena floor, it can be better understood how the large size and position of the Earth globe is arranged to provide a breath-taking view of the Earth from space orbit. At the beginning of the ride the players are orbiting at the rim of the arena floor nearly a quarter of a mile from the globe. As the ride progresses, the players travel in ever closer orbits to the Earth globe until it fills most of their field of view on one side of their craft. (See FIG. 1) At closest approach the players may be 50 to 100 feet, or the like, from the globe.

The globe would be modeled and painted to resemble the Earth as it appears from space with mountains and valleys made in relief and the water regions textured to resemble waves. The globe's features would be modeled in sufficient details so that its construction and fabrication details cannot be discerned at a distance of 50 to 100 feet.

From orbit, the Earth's atmosphere can be seen as a translucent blue layer surrounding the Earth and containing clouds that cover and hide parts of the Earth's surface. In the Earth globe model of this invention, the Earth's atmosphere is modeled by covering the Earth globe with a layer of "Aerogel". Aerogel is a light porous gel in which the liquid component of the gel has been replaced with a gas. Aerogel has a light blue transparent color, which is exactly what is needed to model the atmosphere of the earth on an Earth globe. Aerogel is also the lightest solid known to exist, which would cut the construction weight down for a globe that may be 50 to 100 feet in diameter. The clouds would be modeled by cotton balls or the like, embedded in the Aerogel, and shaped to resemble clouds.

The Earth is illuminated by the sun. In the Space Theme Amusement Park Ride, a model of the sun would be positioned within the dome at an angle of 23.5° to the horizon; the same angle that the Earth's axis is tilted relative to its orbital plane. The sun model may be a hemispheric disk or sphere measuring only 10 to 20 feet in diameter and attached directly to the arena dome high above the arena floor. The surface of the sun model would be covered with a closely packed array of high intensity LED lights giving off light that mimics the color of sunlight. This sun model would essentially be a high intensity lighting fixture positioned to illuminate the Earth globe and the entire arena floor surface with blindingly bright-simulated sunlight. This would cause half the Earth globe to be brightly illuminates and half to be cast in shadow, just at the Earth appears when viewed from space. The Earth globe would cast its sun-induced shadow across part of the arena floor causing orbiting space cars to travel in and out of the simulated Earth's shadow.

The Earth globe 10 would be mounted on a vertical axis mechanism as shown in FIG. 1 with its North-South pole axis positioned in a vertical alignment. The Earth globe would slowly rotate in a direction opposite to the direction the space cars are moving. In this example, the Earth globe would be rotating in a clockwise direction. This would give the players the illusion of passing around the track more times than they actually did. For example, on average a space car would make three or four orbits around the floor before being automatically directed off the floor and returned to their launch points. During that same period the Earth globe may make two or three rotations. This would give the players the illusion of having circled the floor from five to seven times. Furthermore, it would give the players the illusion that they were orbiting at almost twice their actual speed. This would speed up the play action of the game without causing additional safety concerns and give the players a greater feeling of having gotten their money's worth.

Near the Earth globe, control over the space cars is taken over by computer systems that steer the cars, still traveling at high speed, into pathways under the playing floor. During this leg of the journey an artificial fog is established around the space cars resembling the passage of the space cars into the clouds surrounding the earth. These effects are maintained until the space cars arrive at their disembarking stations that are equipped and decorated to resemble air bases on the Earth's surface.

Other Embodiments of the Invention

A wide variation in functional design is possible within the scope of this invention. The size of the facilities may be smaller or greater than the preferred embodiment described here. The dome, the playing floor, and other facilities may have other configurations that satisfy the theme and space car requirements of this space theme amusement park ride. For example, the floor and dome may have a hexagonal, octagonal, or some other enclosed shape. The space cars may have antennas, access doors, auxiliary propulsion means, backup systems, and other features not discussed here. Instead of using air cushions to levitate the space cars off the floor, the cars may employ magnetic levitation. In this case the game floor would be made of non-ferromagnetic materials and have a highly conductive surface. The encircling mall and parking garages need not be considered an essential component of the space car amusement park ride. Many of the features may be simplified, reduced in size and number, and still be considered within the scope of this invention.

The foregoing discussion discloses and describes merely exemplary embodiments of the present invention. One skilled in the art will readily recognize from such discussion, that various changes, modifications and variations can be made therein without departing from the spirit and scope of the invention as defined in the present disclosure. For example, the selection of the colors of lights and other effects, along with the dimensions, sizes and shapes of the various elements of the invention may be modified or changed without departing from the spirit and scope of the invention. Furthermore, while exemplary embodiments have been expressed herein, others practiced in the art may be aware of other designs or uses of the present invention. Thus, while the present invention has been described in connection with exemplary embodiments thereof, it will be understood that many modifications in both design and use will be apparent to those of ordinary skill in the art, and this application is intended to cover any adaptations or variations thereof. It is therefore manifestly intended that this invention is not limited only by the present disclosure and the equivalents thereof.

What I claim is:

1. A bumper car amusement park ride, comprising:

a large open area arena;

at least two bumper cars operatively configures to maneuver along a floor through an entirety of said arena, each of said at least two bumper cars including an air-cushion generating device for generating a cushion of air on which to float above the floor, wherein said bumper cars are configured to be occupied by a plurality of passenger/players, said bumper cars are in part controlled by at least one of said plurality of passenger/players and in part controlled by an automated system such that said bumper cars controllably traverse the entirety of the arena in any horizontal direction;

a launching and retrieval/docking area operatively positioned with said arena and configured to launch said bumper cars to enter said arena;

a retrieval/docking area operatively positioned with said arena and configured to retrieve said bumper cars to exit said arena, and a central control computer and related software wherein said central control computer is located external to said bumper cars and operatively connected to communicate with said bumper cards so as to monitor position and operation of the bumper cars and to take partial or full control over the bumper cars as needed, wherein each of said bumper cars includes a vehicular control computer and related software operatively connected to communicate with at least one player operated control panel and vehicle devices and sensors, and to translate player commands into vehicular responses, said control computer operatively communicates with said vehicular control computers for the exchange of information and commands, and each of said bumper cars includes a plurality of player control stations corresponding to the plurality of passengers/players in the respective bumper car, each of the plurality of player control stations being configured to simulate control of at least one of a plurality of specific control tasks, each of the passengers/players being assigned one of the plurality of specific tasks for operating the respective bumper car according to one of the plurality of player control stations at which a passenger/player is seated.

2. A bumper car amusement park ride of claim 1, whereby the bumper cars are configured as simulated spacecraft.

3. The bumper car amusement park ride of claim 2, wherein each of the bumper cars includes air jets that can be controlled by at least one passenger/player to steer, change speed and maneuver a corresponding bumper car.

4. The bumper car amusement park ride of claim 2, wherein each of the bumper cars is equipped with one or more simulated laser guns by which to engage in simulated combat with other bumper cars.

5. The bumper car amusement park ride of claim 4, wherein each of the bumper cars is equipped with detector panels that can detect a hit by a simulated laser gun from another bumper car.

6. The bumper car amusement park ride of claim 1, wherein each of said bumper cars includes a plurality of player control stations corresponding to the plurality of passengers/players in the respective bumper car, each of the plurality of player control stations being configured with a control interface corresponding to at least one of a captain control station, a navigator control station, a helmsman control station and a gunner control station, each of the passengers/players being assigned to one of the captain control station, the navigator control station, the helmsman control station and the gunner control station for operating the respective bumper car according to a corresponding one of the plurality of player control stations at which a passenger/player is seated.

7. The bumper car amusement park ride of claim 6, wherein the vehicular control computer and related software are further configured to translate player commands inputted via the captain control station, the navigator control station, the helmsman control station and the gunner control station into corresponding vehicular responses.

8. The bumper car amusement park ride of claim 7, wherein the captain control station is further configured to include simulating energy allocation control whereby the vehicular control computer and related software are configured to translate energy allocation control inputted via the captain control station into corresponding vehicle responses based on the inputted energy allocation control.

9. A method for operating a bumper car amusement park ride that includes a large open area arena, at least two bumper cars operatively configures to maneuver along a floor of said arena, each of said at least two bumper cars including an air-cushion generating device for generating a cushion of air on which to float above the floor, the method comprising the steps of:

occupying each of said bumper cars with a plurality of passenger/players;

controlling each of said bumper cars are in part by said plurality of passenger/players and in part by an automated system such that said bumper cars controllably traverse a entirety of the arena in any horizontal direction;

a launching said bumper cars to enter said arena;

further controlling said bumper cars such that said bumper cars move in a circular pattern around and progressively closer to a center of the arena, including providing each of said bumper cars with a plurality of player control stations corresponding to the plurality of passengers/players in the respective bumper car, each of the plurality of player control stations being configured to corresponding to at least to one of a plurality of specific control tasks, each of the passengers/players being assigned one of the plurality of specific tasks for operating the respective bumper car according to one of the plurality of player control stations at which a passenger/player is seated; and providing a central control computer and related software located external to said bumper cars, wherein the central control computer communicates with said bumper cars as to monitor position and operation of the bumper cars and to take partial or full control over the bumper cars as needed;

providing each of said bumper cars with a vehicular control computer and related software, wherein the vehicular control computer communicates with at least one player operated control panel and vehicle devices and sensors, and to translate player commands into vehicular responses, wherein said central control computer operatively communicates with said vehicular control computers for the exchange of information and commands;

retrieving said bumper cars to exit said arena when said bumper cars reach a predetermined position near the center of the circular arena, wherein said bumper cars are allowed to maneuver in the arena while moving progressively closer to the center of the arena.

10. A method for operating a bumper car amusement park ride of claim 9, whereby the bumper cars are configured as simulated spacecraft.

11. The method for operating a bumper car amusement park ride of claim 10, wherein each of the bumper cars includes air jets that can be controlled by at least one passenger/player to steer, change speed and maneuver a corresponding bumper car.

12. The method for operating a bumper car amusement park ride of claim 10, wherein each of the bumper cars is equipped with one or more simulated laser guns by which to engage in simulated combat with other bumper cars.

13. The method for operating a bumper car amusement park ride of claim 12, wherein each of the bumper cars is equipped with detector panels that can detect a hit by a simulated laser gun from another bumper car.

14. The method for operating a bumper car amusement park ride of claim 9, wherein the step of further controlling said bumper cars such that said bumper cars move in a circular pattern around and progressively closer to a center of the arena, includes providing each of said bumper cars with a plurality of player control stations corresponding to the plurality of passengers/players in the respective bumper car, each of the plurality of player control stations being configured with a control interface corresponding to at least one of a captain control station, a navigator control station, a helmsman control station and a gunner control station, each of the passengers/players being assigned to one of the captain control station, the navigator control station, the helmsman control station and the gunner control station for operating the respective bumper car according to a corresponding one of the plurality of player control stations at which a passenger/player is seated.

15. The method for operating a bumper car amusement park ride of claim 14, wherein the vehicular control computer and related software are further configured to translate player commands inputted via the captain control station, the navigator control station, the helmsman control station and the gunner control station into corresponding vehicular responses.

16. The bumper car amusement park ride of claim 15, wherein the captain control station is further configured to include simulating energy allocation control whereby the vehicular control computer and related software are configured to translate energy allocation control inputted via the captain control station into corresponding vehicle responses based on the inputted energy allocation control.

* * * * *